US007000959B2

(12) United States Patent
Sanders

(10) Patent No.: US 7,000,959 B2
(45) Date of Patent: Feb. 21, 2006

(54) ADJUSTABLE STRIKE MOUNTING SYSTEM

(75) Inventor: Vernard W. Sanders, Oxnard, CA (US)

(73) Assignee: Pemko, Ventura, CA (US)

( * ) Notice: Subject to any disclaimer, the term of this patent is extended or adjusted under 35 U.S.C. 154(b) by 0 days.

(21) Appl. No.: 10/762,806

(22) Filed: Jan. 21, 2004

(65) Prior Publication Data

US 2005/0127692 A1 Jun. 16, 2005

Related U.S. Application Data

(60) Provisional application No. 60/441,793, filed on Jan. 21, 2003.

(51) Int. Cl.
*E05B 15/02* (2006.01)

(52) U.S. Cl. ..... 292/340; 292/341; 292/341.14; 292/341.18; 292/341.19

(58) Field of Classification Search ..... 292/340, 292/341, 341.14, 341.18, 341.19, DIG. 51, 292/DIG. 53, DIG. 60; 49/394, 395
See application file for complete search history.

(56) References Cited

U.S. PATENT DOCUMENTS

| | | | | |
|---|---|---|---|---|
| 3,617,080 A | * | 11/1971 | Miller | 292/38 |
| 4,058,332 A | * | 11/1977 | DiFazio | 292/147 |
| 4,113,293 A | | 9/1978 | Paquette | |
| 4,429,493 A | | 2/1984 | St. Aubin | |
| 4,492,397 A | | 1/1985 | Allenbaugh | |
| 4,644,696 A | | 2/1987 | Bursk | |
| 5,118,151 A | | 6/1992 | Nicholas, Jr. | |
| 5,171,050 A | | 12/1992 | Mascotte | |
| 5,328,217 A | | 7/1994 | Sanders | |
| 5,337,451 A | | 8/1994 | Goossens | |
| 5,350,207 A | | 9/1994 | Sanders | |
| 5,492,208 A | | 2/1996 | Goossens | |
| RE35,618 E | | 10/1997 | Goossens | |
| 5,678,871 A | | 10/1997 | Zarzycki, Jr. | |
| 5,857,291 A | | 1/1999 | Headrick | |
| 5,893,594 A | | 4/1999 | Zarzycki, Jr. | |
| 6,170,210 B1 | | 1/2001 | Marts | |
| 6,457,751 B1 | | 10/2002 | Hartman | |
| 6,491,326 B1 | | 12/2002 | Massey et al. | |

* cited by examiner

*Primary Examiner*—Brian E. Glessner
*Assistant Examiner*—Carlos Lugo
(74) *Attorney, Agent, or Firm*—Marvin E. Jacobs

(57) ABSTRACT

An adjustable strike mounting system having a cover plate, which can be mounted to an astragal having a housing, which has a longitudinal channel having retention guides, vertically slidable blocks, which have transverse slots, having horizontally slidable threaded elements, and spring leaves, which are adapted to hold the vertically slidable blocks in selected positions, the cover plates adapted to provide mounting surfaces for the strike plates, the cover plates abutting the retention guides, the strike plates having apertures, which can be aligned with locations of the locks and deadbolts quickly, easily, and efficiently, the adjustable strike mounting system facilitating and allowing vertical and horizontal movement of the strike plates in the astragal, facilitating location and alignment of fasteners, and minimizing loss of the fasteners within the astragal and resultant jamming of the astragal and other operating parts of the astragal.

36 Claims, 8 Drawing Sheets

ADJUSTABLE STRIKE MOUNTING SYSTEM

This application claims the benefit of Ser. No. 60/441,793 filed Jan. 21, 2003.

BACKGROUND OF THE INVENTION

1. Field of the Invention

The present invention relates generally to strikes and more particularly to adjustable strikes.

2. Background Art

Double entrance doorways are used in a large variety of residential homes and commercial buildings. Typically, an active door provides for day to day ingress and egress to and from the residential home or building, and an inactive door remains closed, except in instances when a width greater than or equal to the width of the active door and less than or equal to the width of the double entrance doorway is required, such as, for example, for delivery of furniture and/or equipment that cannot fit through the double entrance doorway. If large objects, such as furniture and/or equipment must pass through the double entrance doorway, both the normally inactive door and the active door of the doorway are opened, to create a wide entrance way, through which the furniture and/or equipment may pass.

Mating edges of the inactive door and the active door do not typically contact one another directly, but are separated by an astragal, the astragal being attached to the edge of an inactive leaf, the astragal extending the length of the inactive door, cushioning the closing of the active door and associated inactive leaf of the doorway, and sealing gaps between the inactive door and the active door.

The astragals often have upper and lower bolt-slide assemblies, which lock the astragals and the inactive doors to upper and lower portions of a door frame surrounding the double entrance door way. The upper and lower bolt-slide assemblies have bolts, which slide within upper and lower ends of the astragal, and are pushed outwardly from the inactive door to extend beyond the ends of the astragal, and are received by upper and lower apertures in the upper and lower portions of the door frame, also known as the header and threshold sill, respectively, to lock the inactive door in place.

The astragals typically have strike plates installed on the inactive door. The strike plates accept bolts, from deadbolts and locksets installed on the active door, which are used to lock the active door to the inactive door, and, thus, lock and restrict access through the double entrance doorway. The process of installing the strike plates on the inactive door requires alignment of the bolts with apertures of the strike plates, the process often time consuming and tedious, with strike fasteners difficult to locate and align on the astragal, often falling into the astragal, and jamming the astragal and other operating parts of the astragal.

There is thus a need for an adjustable strike mounting system, which allows at least one strike plate to be fastened to an astragal installed and/or incorporated into the edge of an inactive door of a double entrance doorway, facilitates quick, easy, and efficient installation and alignment of the strike plates with locks and deadbolts installed in the active door, allows vertical and horizontal movement of the strike plates in the astragal, facilitates location and alignment of fasteners, and minimizes loss of the fasteners within the astragal and resultant jamming of the astragal and other operating parts of the astragal.

The adjustable strike mounting system should have a cover plate, which can be mounted to an astragal having a housing, which has a longitudinal channel having retention guides, vertically slidable blocks, which have transverse slots, having horizontally slidable threaded elements, and spring leaves, which are adapted to hold the vertically slidable blocks in selected positions, the cover plates adapted to provide mounting surfaces for the strike plates, the cover plates abutting the retention guides, the strike plates having apertures, which can be aligned with locations of the locks and deadbolts quickly, easily, and efficiently.

Different adjustable strikes have heretofore been known. However, none of the adjustable strikes adequately satisfies these aforementioned needs.

U.S. Pat. Nos. 5,350,207 and 5,328,217 (Sanders) disclose locking astragals, for attaching to an inactive leaf of a double doorway, and in particular U.S. Pat. No. 5,328,217 discloses an adjustable strike plate. Each of the locking astragals has an elongated astragal casing, which has a channel and bolt-slide assemblies mounted slidably within the channel. Each bolt-slide assembly includes a latching member and bolt. By depressing the latching member, the latching member can slide through the channel, to extend and lock the bolts into indentations in upper and lower surfaces of a door frame. The bolts may also be retracted back into the astragal, to open the inactive leaf. Each of the latching members has an integral spring, which simplifies fabrication and assembly.

U.S. Pat. No. 6,491,326 (Massey, et al) discloses a swing adaptable astragal with lockable unitary flush bolt assemblies, for double door entryways, which includes an extruded aluminum frame into which upper and lower flush bolt assemblies are slidably disposed. The flush bolt assemblies include a long metal bolt about which is injection overmolded a series of retainer guides, which ride in the frame. Locking mechanisms are also integrally overmolded onto the bolts. The frame and all components of the astragal assembly are symmetrical and reversible, so that the assembly is non-handed; that is, it can be adapted to both a right hand swing and a left-hand swing inactive door. A strike plate mounting system and bottom-sealing block are provided, and the upper end of the assembly includes means for sealing against a stop of a head jamb. Drafts at upper and lower inside corners of the doors of a double door entryway may be prevented.

U.S. Pat. No. 5,118,151 (Nicholas, Jr., et al) discloses an adjustable door strike and mounting template, having a striker plate, a main body, and a slider plate. The main body is affixed to a door jamb, with the slider plate between the door jamb and the main body, and adjustably mounted for receiving a standard striker plate. The main body is provided with an elongated aperture in the vertical direction, which permits the striker plate to have a continuous range of adjustments in the vertical direction. A mounting template for facilitating the installation of a door strike is also disclosed. The adjustable door strike and mounting template allow for mounting a door lock with either or both a latch and a deadbolt, without adversely affecting the door jamb.

U.S. Pat. No. 5,171,050 (Mascotte) discloses an adjustable strike for door-locking and door-latching mechanisms of a door hingedly mounted onto a door frame, which comprises a plate member, having spaced openings mounted along an aperture of the door frame, and secured thereto for receiving plungers of the door-locking and door-latching mechanisms, to maintain the door in a closed and/or locked position. An adjustment member is located on the plate member adjacent at least the opening, for receiving the plunger of the door-latching mechanism, and being adjustable for engagement with such plunger to prevent play between the door and the door frame, when the door is in a closed and latched position.

U.S. Pat. No. 4,492,397 (Allenbaugh) discloses an adjustable strike, comprising a strike plate, having a center section, with an aperture for receiving a bolt or latch, and upper and lower sections, disposed on opposite sides of the center section, that include interlock surfaces and horizontally elongated slots for receiving screws. Upper and lower keeper plates have corresponding interlock surfaces that engage those of the strike plate in a selected position to prevent movement of the strike plate. The keeper plates have round screw holes that can be aligned with the slots of the strike plate. Preferably, the interlock surfaces are formed by contiguous, V-shaped, vertically extending grooves.

U.S. Pat. No. 4,113,293 (Paquette) discloses an adjustable strike for a latch bolt of a swinging door, the strike having a face plate to be placed over an appropriate cavity, and having a lip to extend into a doorway to engage and to press the latch bolt as the door closes. A flange is secured normal to the plate to extend into or beside the cavity, between the plate opening and the lip. A bolt extends through the flange, preferably being threaded therethrough. A movable wall, parallel to the flange, and spaced therefrom, is secured to the end of the bolt, and situated within the cavity behind the face plate, to be positioned within the plate opening, so that a keeper surface of the latch bolt bears against this wall, when the door is closed. Longitudinal movement of the bolt and the flange causes the wall to move towards or away from the flange, thereby altering the distance between the door stop and the movable wall. The wall is moved to a distance which provides a secure fit of the latch bolt and minimizes rattling of the closed door. The adjustable strike facilitates hanging of a door on a door frame, and subsequent adjustments required to minimize vibration of the door when closed.

U.S. Pat. No. 5,857,291 (Headrick) discloses an astragal with integral sealing lock block, for use with a double door installation, which includes an astragal strip secured along a vertical edge of an inactive door. A lock block is slidably disposed in at least one end of the astragal strip, and can be moved between an extended position, for securing the inactive door, and a retracted position for freeing the inactive door. The lock block has a projecting bolt receivable in a receptacle in a door frame, when the lock block is slid to its extended position. A gasket is secured to an end of the lock block, and the bolt passes through an opening in the gasket. The gasket engages and seals against the door frame, when the lock block is in its extended position. Gaskets are also provided on the sides of the lock block, for engaging and sealing against the doors of the double door installation. When the doors are closed and secured in place, the lock block and gasket assembly prevents drafts from flowing under the door installation beneath the astragal thereof.

U.S. Pat. Nos. 5,337,451 and Re. 35,618 (Goossens) disclose a gear hinge, having a thrust bearing. The hinge may include, in various combinations, gears having relatively small, rounded teeth, hinge members, which have anodized surfaces, bearings, which may be produced by a gas assisted injection molding process, and bearings, which are relatively hard.

Applications for gear hinges include swinging doors and folding curtains, used to divide large rooms. Typically, such hinges have bearing blocks, to prevent longitudinal movement of the gear hinges within the doors and folding curtains.

U.S. Pat. No. 5,492,208 (Goossens) discloses an intumescent security pin for fire rated doors. In a door assembly composed of a door frame, a door having a hinge side and a hinge supporting the door on the frame, for pivotal movement of the door between an open position and a closed position, the hinge side of the door facing, and being adjacent to, a portion of the frame when the door is in the closed position, the door is provided with a recess in the hinge side; and the assembly is further provided with at least one projecting element secured to the frame portion to project into the recess, when the door is in the closed position and having a mass of thermally intumescent material, which is expandable for securing the projecting element to the door, upon being heated above a predetermined temperature.

U.S. Pat. No. 6,170,210 (Marts) discloses a continuous gear hinge with intumescent seals, having extruded aluminum leaves and an extruded aluminum cap, which holds the leaves together at meshed gear segments on the leaves, and has the capacity to establish a seal between the door and hinge jamb to which it is attached. That seal derives from intumescent strips, which lie in recesses that open out of the leaves. In the presence of a fire, the intumescent material, the strips of which extend the full length of the hinge, expands and bonds to the door and hinge jamb to not only seal the space between the two, but also to secure the door, should the hinge lose its capacity to hold the door.

U.S. Pat. No. 4,429,493 (St. Aubin) discloses an astragal housing seal and lock, for use in a double door assembly having an active door and a relatively inactive door. The astragal has a vertically extending mullion housing, which is attached to a free edge of the relatively inactive door. A vertically extending slide section is mounted on the mullion housing on a sealing side of the free edge of the inactive door. The slide section extends from the free vertical edge of the inactive door, when the active door is in the closed position. The slide section is vertically movable from an unlocked position to a locked position, wherein the slide section is moved vertically downward, with respect to the mullion housing, to engage the sill/threshold of the door frame, thereby preventing movement of the inactive door.

U.S. Pat. No. 4,644,696 (Bursk) discloses a patio door assembly for removable astragal, in which a double door installation includes an astragal, which is removably mounted in a head jamb and sill portions of a door frame independently of the doors, the combination including a locking mechanism in one door, which incorporates a bolt arranged to project through the astragal into the other door to effect locking of both doors to each other and to the astragal.

U.S. Pat. Nos. 5,893,594 and 5,678,871 (Zarzycki, Jr.) disclose a security astragal, which includes a security bar, that protects against tampering, having a door latching mechanism and a protective sheath, that secures the security bar from unauthorized removal.

U.S. Pat. No. 6,457,751 (Hartman) discloses a locking assembly for an astragal, which can be attached to an inactive door of a double door unit of a residence or a building. The astragal is attached to an edge of the inactive door in space between the inactive door and active door. A separate locking assembly is attached adjacent a top end of the door and also adjacent a bottom end of the door. A plug having an elongated locking bolt extending therefrom is mounted in a front end of a carriage member. Additional structure is provided for reciprocal travel of the carriage member between a locked position and an unlocked position.

U.S. Pat. No. 5,335,450 (Procton) discloses an astragal, which has an exterior aluminum extrusion and an interior wooden portion. The exterior extrusion includes a pair of rearwardly extending center walls, which form a channel for receiving the wooden interior portion. Attachments and door hardware can be installed in the wooden interior portion, while the extruded exterior acts as cladding.

For the foregoing reasons, there is a need for an adjustable strike mounting system, which allows at least one strike plate to be fastened to an astragal installed and/or incorporated into the edge of an inactive door of a double entrance doorway, facilitates quick, easy, and efficient installation and alignment of the strike plates with locks and deadbolts installed in the active door, allows vertical and horizontal movement of the strike plates in the astragal, facilitates location and alignment of fasteners, and minimizes loss of the fasteners within the astragal and resultant jamming of the astragal and other operating parts of the astragal. The adjustable strike mounting system should have a cover plate, which can be mounted to an astragal having a housing, which has a longitudinal channel having retention guides, vertically slidable blocks, which have transverse slots, having horizontally slidable threaded elements, and spring leaves, which are adapted to hold the vertically slidable blocks in selected positions, the cover plates adapted to provide mounting surfaces for the strike plates, the cover plates abutting the retention guides, the strike plates having apertures, which can be aligned with locations of the locks and deadbolts quickly, easily, and efficiently.

SUMMARY

The present invention is directed to an adjustable strike mounting system, which allows at least one strike plate to be fastened to an astragal installed and/or incorporated into the edge of an inactive door of a double entrance doorway, facilitates quick, easy, and efficient installation and alignment of the strike plates with locks and deadbolts installed in the active door, allows vertical and horizontal movement of the strike plates in the astragal, facilitates location and alignment of fasteners, and minimizes loss of the fasteners within the astragal and resultant jamming of the astragal and other operating parts of the astragal.

The adjustable strike mounting system has a cover plate, which can be mounted to an astragal having a housing, which has a longitudinal channel having retention guides, vertically slidable blocks, which have transverse slots, having horizontally slidable threaded elements, and spring leaves, which are adapted to hold the vertically slidable blocks in selected positions, the cover plates adapted to provide mounting surfaces for the strike plates, the cover plates abutting the retention guides, the strike plates having apertures, which can be aligned with locations of the locks and deadbolts quickly, easily, and efficiently.

An adjustable strike mounting system having features of the present invention comprises: a channel having an opening, a bottom and longitudinally disposed opposing tracks; a cover plate straddling the opening and abutting the longitudinally disposed opposing tracks, the cover plate having an aperture; male fasteners; female fasteners; a strike plate having an aperture and holes receiving the male fasteners therethrough; the strike plate abutting the cover plate, the strike plate aperture and the cover plate aperture substantially common one with the other, the strike plate aperture receiving the strike plate received male fasteners therethrough; positioning blocks adapted to align the strike plate aperture with a bolt, each the positioning block having a chamber, the chamber having one of the female fasteners therein, and a hole from the exterior of the block to the chamber receiving one of the received cover plate male fasteners therethrough, the male fastener mating with and fastened to the female fastener therein the chamber, the chamber adapted to retain the female fastener therein when the male fastener is fastened to the female fastener, and transverse sets of opposing rails and adjacent spring leaves, the transverse sets of opposing rails and adjacent spring leaves mounted therein the channel between the bottom and the opposing tracks of the channel.

DRAWINGS

These and other features, aspects, and advantages of the present invention will become better understood with regard to the following description, appended claims, and accompanying drawings where:

REFERENCE NUMERALS

Figure 1:
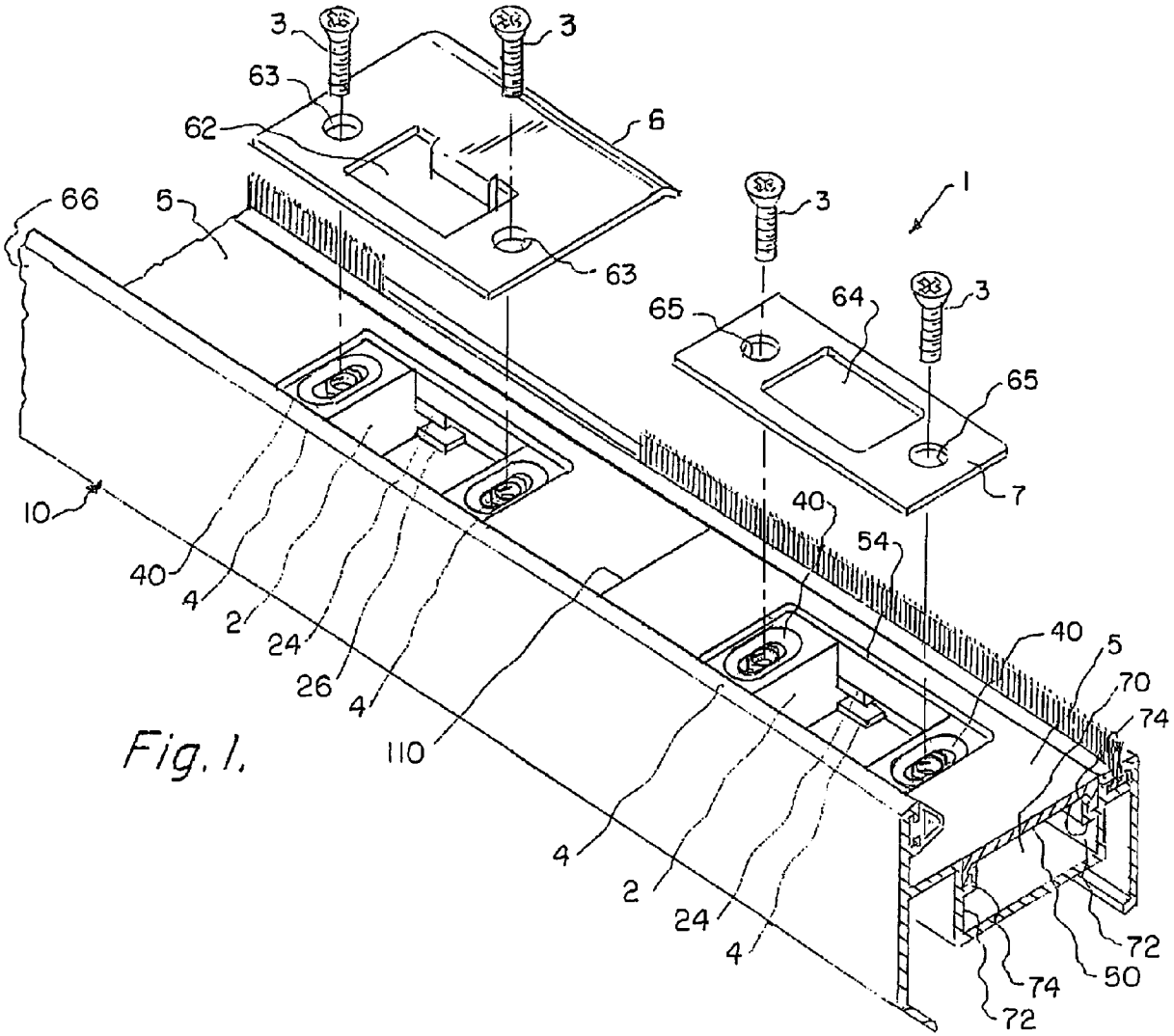
FIG. 1 is a perspective view of an adjustable strike mounting system, constructed in accordance with the present invention.
Figure 2:
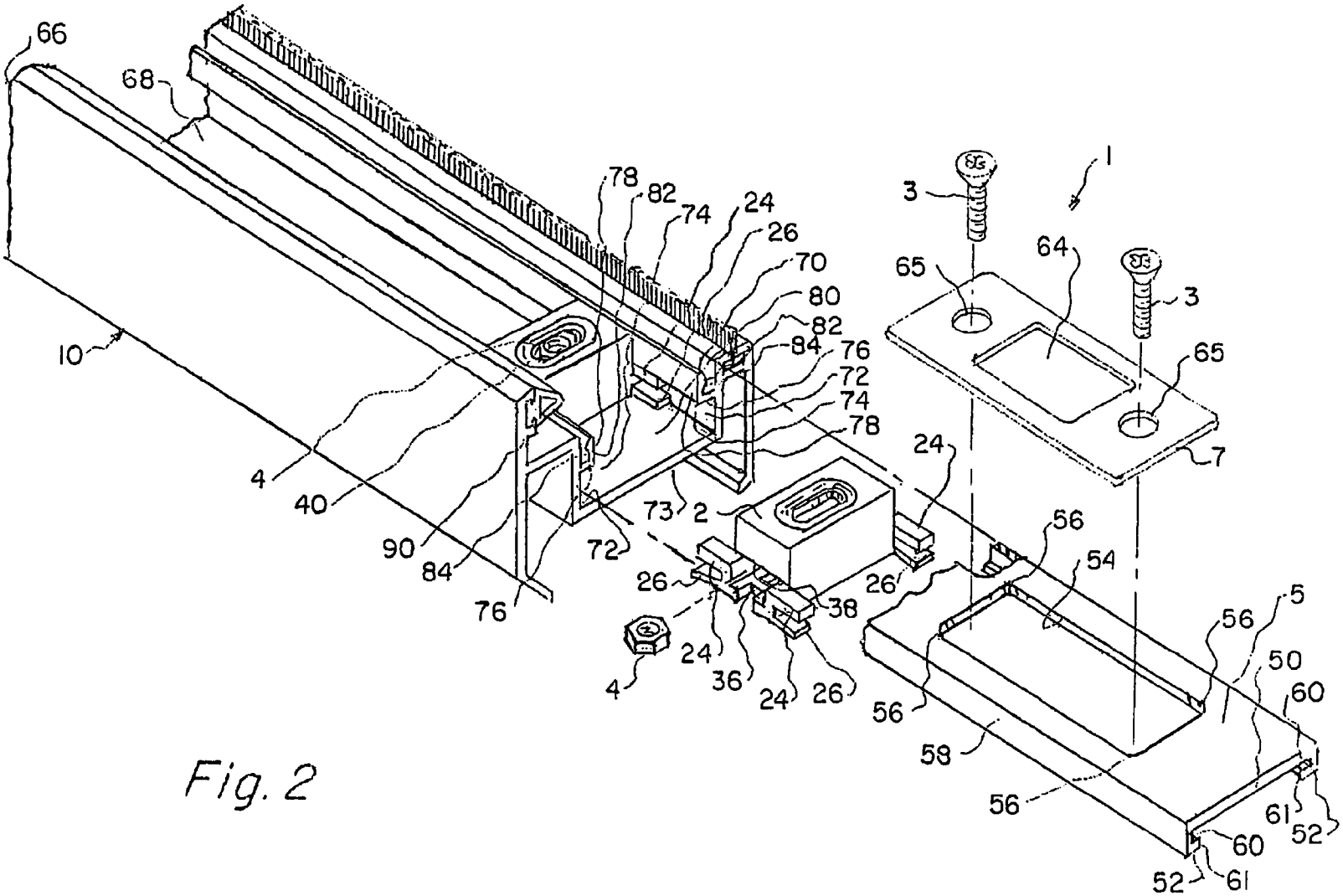
FIG. 2 is an exploded view of a portion of the adjustable strike mounting system.
Figure 3:
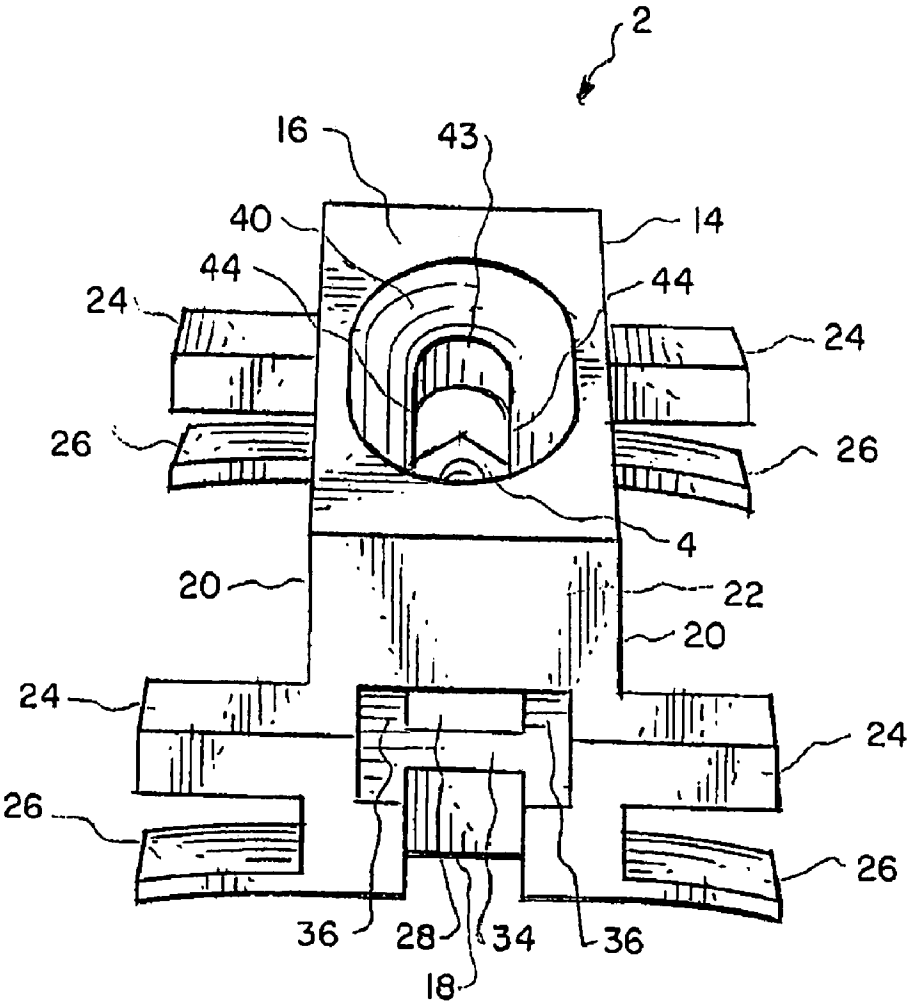
FIG. 3 is a perspective view of a positioning block of the adjustable strike mounting system.

These and other features, aspects, and advantages of the present invention will become better understood with regard to the references and associated reference numerals of the following description and accompanying drawings where:

1 adjustable strike mounting system
2 positioning block
3 screw
4 nut
5 cover plate
6 lockset strike
7 deadbolt strike
10 astragal

14 block
16 block top
18 block bottom
20 block side
22 block end
24 retaining rail
26 spring leaf
28 chamber
30 chamber roof
32 roof rails
34 chamber floor
36 floor rails
38 hole
40 oblong hole
42 rectangular hole
43 oblong hole arcuate end
44 oblong hole side
50 plate
52 cover plate side
54 cover plate aperture
56 aperture corner
58 exterior edge
60 interior edge
61 cover plate retaining lip
62 lockset strike aperture
63 lockset strike hole
64 deadbolt strike aperture
65 deadbolt strike hole
66 astragal housing
68 longitudinal channel
70 longitudinal channel bottom
72 longitudinal channel wall
73 longitudinal channel end
74 L shaped retention guide
76 retention guide base
78 retention guide side
80 retention guide edge
82 retention guide retaining lip
84 side channel
90 inactive door edge
92 inactive door
94 door frame
96 astragal end
98 astragal bolt
100 sill
102 header
104 lockset
106 deadbolt
108 active door
110 seam
300 alternate astragal housing
302 saw tooth recess
304 finned tail
306 foam weather strip
308 cavity
310 alternate astragal housing
312 thermal break
314 slot
320 alternate astragal
322 alternate astragal housing
324 cover
326 outer seal
328 inner seal
330 alternate astragal
332 thermal break
340 alternate astragal
342 cover element
344 saw tooth recess
346 finned tail
348 weather strip seal
349 inner seal
350 alternate astragal
352 thermal break

DESCRIPTION

The preferred embodiments of the present invention will be described with reference to FIGS. 1–13 of the drawings. Identical elements in the various figures are identified with the same reference numbers.

FIGS. 1–7 show an embodiment of the present invention, an adjustable strike mounting system 1, which comprises positioning blocks 2, screws 3, nuts 4, a cover plate 5, and a lockset strike 6 and/or deadbolt strike 7, for use with an astragal 10.

Each of the positioning blocks 2 comprises a block 14 having a top 16, a bottom 18, opposing sides 20, and opposing ends 22, and transverse sets of opposing retaining rails 24 and adjacent spring leaves 26 molded to the opposing ends 22 of the block 14, the block 14 having a chamber 28, which has a roof 30 having roof rails 32 and a floor 34 having floor rails 36, the chamber 28 and the opposing roof rails 32 defined by a hole 38 through the block 2 from one of the opposing ends 22 to the other one of the opposing ends 22 and an oblong hole 40 through the top 16 of the block 14 to the roof 30 of the chamber 28, the chamber 28 and the opposing floor rails 36 defined by a substantially rectangular hole 42 through the floor 34 of the chamber 28 to the bottom 18 of the block 2, the oblong hole 40 having arcuate ends 43 and substantially parallel sides 44, and preferably being countersunk. The chamber 28 also has sides, which may have nibs and/or small projections protruding therefrom.

Each of the cover plates 5 comprises a substantially planar plate 50 and opposing sides 52, which are substantially perpendicular to the substantially planar plate 50, the substantially planar plate 50 having a substantially rectangular aperture 54, which has arcuate corners 56, each of the opposing sides 52 having a substantially planar exterior edge 58 and an interior edge 60 having a longitudinal retaining lip 61.

The lockset strike 6 has aperture 62 and holes 63, and the deadbolt strike 7 has aperture 64 and holes 65.

The astragal 10 has astragal housing 66 having a longitudinal channel 68, which has a bottom 70, opposing walls 72, and opposing ends 73, each of the opposing walls 72 having a track or longitudinal substantially L shaped retention guide 74, which has a longitudinal base 76 substantially perpendicular to the longitudinal wall 72 and a longitudinal side 78 substantially parallel to the longitudinal wall 72, the longitudinal side 78 having an edge 80 having a longitudinal retaining lip 82 adjacent to and facing the longitudinal wall 72, and which forms a longitudinal side channel 84.

Figure 4:
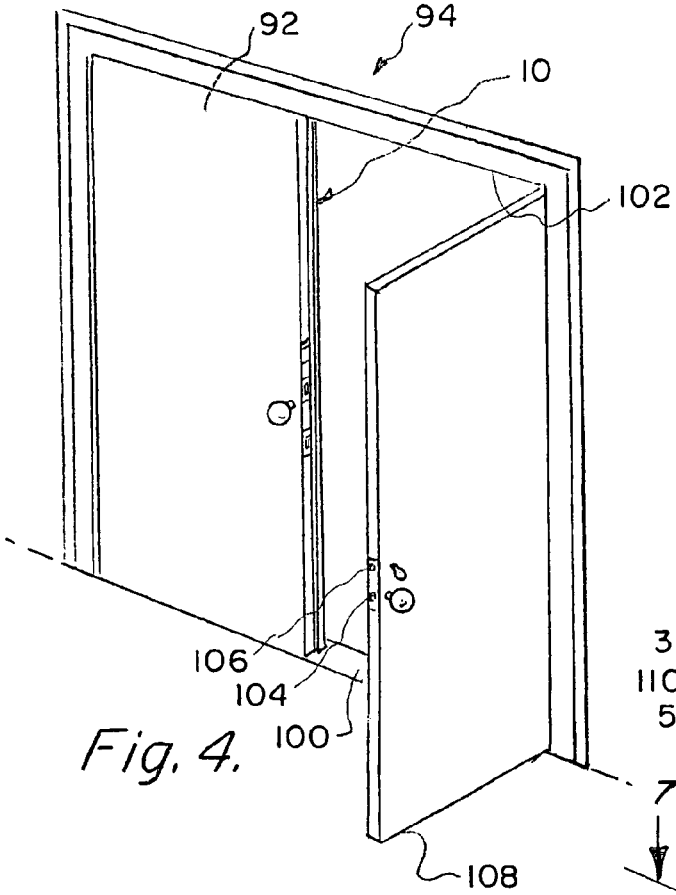
FIG. 4 is a perspective view of entrance doors, comprising an inactive door, shown in a closed position, and an active door.
Figure 5:
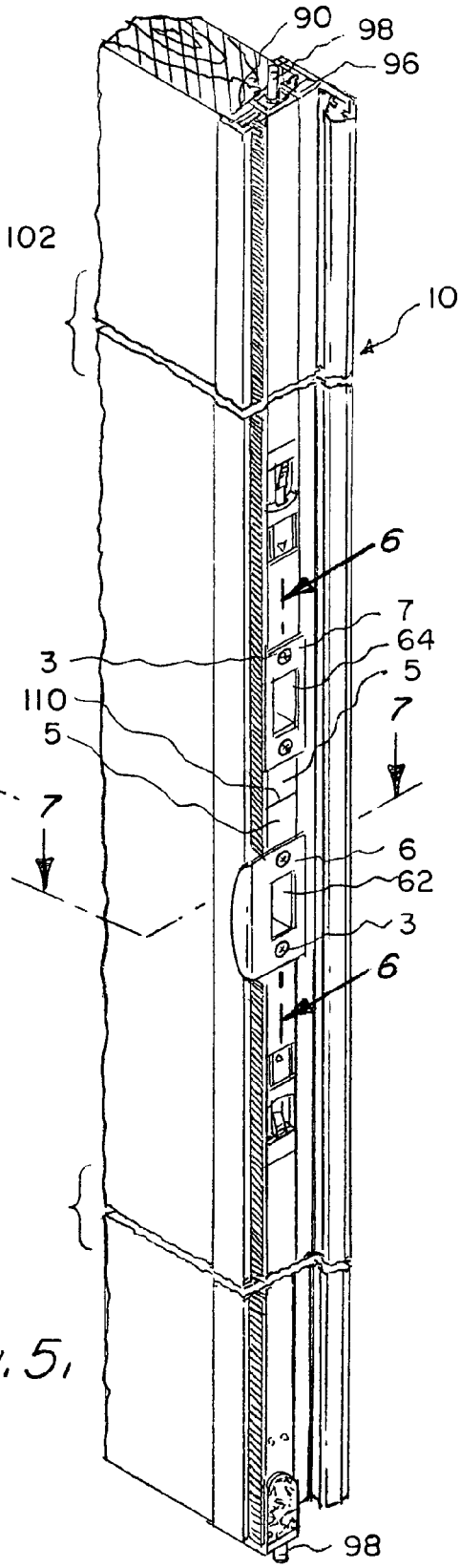
FIG. 5 is a perspective view of the inactive door, showing the adjustable strike mounting system and an astragal installed thereon the inactive door.
Figure 6:
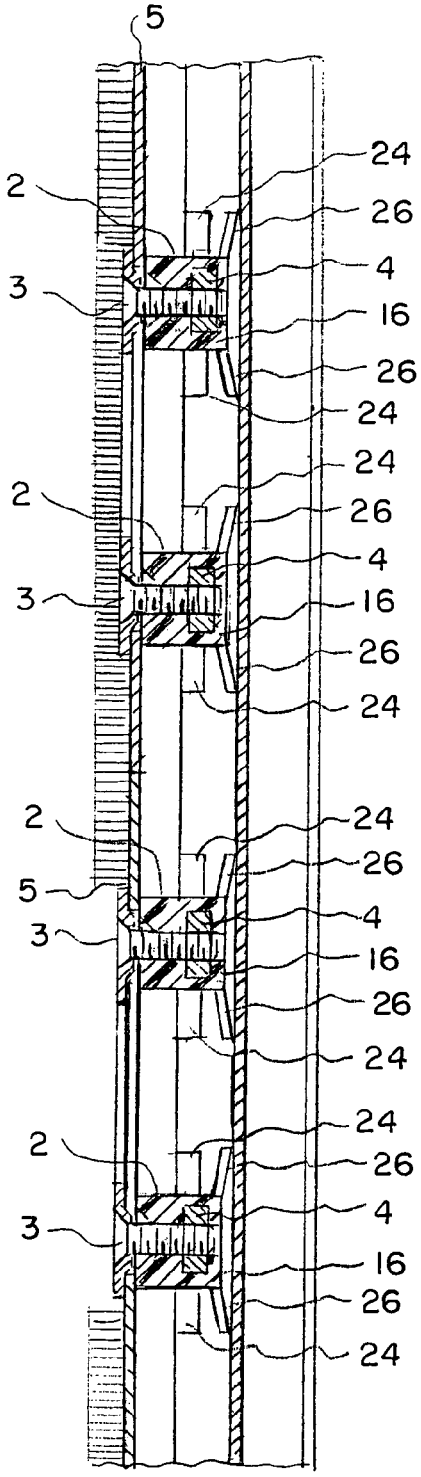
FIG. 6 is a section view of the adjustable strike mounting system.
Figure 7:
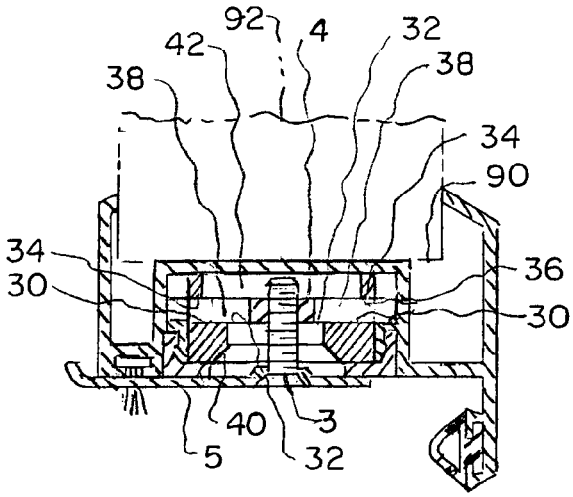
FIG. 7 is another section view of the adjustable strike mounting system.

The astragal 10 is mounted to edge 90 of inactive door 92 of door frame 94, and the adjustable strike mounting system 1 is mounted to the astragal 10, as shown in FIGS. 4 and 5. The astragal 10 has opposing ends 96 and bolts 98, the bolts 98 slidably mounted in the longitudinal channel 68 of the astragal 10 at the opposing ends 96, for securing the inactive door 92 to sill 100 and/or header 102 of the door frame 94. The astragal 10 may have actuating means for retracting and/or extending the bolt 98 into the sill 100 and/or the header 102. Lockset 104 and/or deadbolt 106 are mounted to active door 108 of the door frame 94.

The adjustable strike mounting system 1 is installed onto the astragal 10, as follows:

the nuts 4 are inserted into the holes 38 of the positioning blocks 2, the nuts 4 being forced to pass the nibs and/or small projections on the sides of the chambers 28 of the positioning blocks 2, once passed the nibs and/or small projections preventing the nuts 4 from falling out of the positioning blocks 2 and maintaining the nuts 4 in suitable positions adjacent the oblong holes 40 to allow the screws 3 to be easily fastened thereto, upon completion of which each of the positioning blocks 2 has one of the nuts 4 therein;

each of the positioning blocks 2 is inserted into one of the opposing ends 73 of the longitudinal channel 68 of the astragal 10 and slid to a selected location, estimated to be in the vicinity of the lockset 104 and/or the deadbolt 106 mounted on the active door 108 when the active door 108 and the inactive door 92 are closed adjacently abutting one another, the opposing retaining rails 24 of the positioning blocks 2 abutting the longitudinal base 76 of the longitudinal substantially L shaped retention guide 74 and the spring leaves 26 of the positioning blocks 2 being spring loaded under compression and abutting the bottom 70 of the longitudinal channel 68 of the astragal 10, the positioning blocks 2 being retained in place by the opposing retaining rails 24 and the spring loaded spring leaves 26 and holding the positioning blocks 2 at the selected locations during installation of the adjustable strike mounting system 1;

the astragal 10 is mounted to the edge 90 of the inactive door 90;

the cover plates 5 are trimmed or cut to appropriate lengths, the lengths of which preferably hide seam 110 beneath the lockset strike 6 and/or the deadbolt strike 7, and snapped onto the astragal 10, the cover plates 5 being held in place during installation by the substantially planar exterior edges 58 and the interior edges 60 of the cover plates 5 being force fit into the longitudinal side channels 84 of the astragal 10, the longitudinal retaining lips 61 of the cover plates 5 abuttingly adjacent the longitudinal retaining lips 82 of the longitudinal side channels 84 of the astragal 10;

the cover plates 5 may alternatively be cut or trimmed to the appropriate lengths, inserted into one of the opposing ends 73 of the longitudinal channel 68 of the astragal 10, and slid into place, prior to the astragal 10 being mounted to the edge 90 of the inactive door 90;

the lockset strike 6 and/or the deadbolt strike 7 are loosely fitted to the positioning blocks 2 by inserting the screws 3 through the holes 63 of the lockset strike 6 and the holes 65 of the deadbolt strike 7 through the substantially rectangular apertures 54 of the cover plates 5, through the oblong holes 40 of the positioning blocks 2, and loosely fastening the screws 3 to the nuts 4 therein, the lockset strike 6 and/or the deadbolt strike 7 adjacent the cover plates 5, the lockset strike 6 and/or the deadbolt strike 7 being pulled toward the positioning blocks 2, as the screws 3 are fastened to the nuts 4;

the aperture 62 of the lockset strike 6 is matinlgy aligned with a bolt of the lockset 104, and the aperture 64 of the deadbolt strike 7 is matingly aligned with the deadbolt 106, the screws 3 and nuts 4 being slid within the holes 38 in the lengthwise direction of the oblong holes 40 for horizontal alignment of the lockset strike 6 and/or the deadbolt strike 7 on the astragal 10, the nuts 4 being slidable within the holes 38, the positioning blocks 2 being slid up and/or down for vertical alignment of the lockset strike 6 and/or the deadbolt strike 7, the positioning blocks 2 being slidable within the longitudinal channel 68 of the astragal 10, the countersunk portions of the oblong holes 40 aiding in alignment and preventing any countersunk portions of the holes 63 of the lockset strike 6 and/or any countersunk portions of the holes 65 of the deadbolt strike 7 and/or heads of the screws 3 from interfering with the positioning blocks 2 one with the other;

upon completion of matinlgy aligning the aperture 62 of the lockset strike 6 with the lockset 104 and matingly aligning the aperture 64 of the deadbolt strike 7 with the deadbolt 106, the screws 3 are fastened to the nuts 4, completing the installation, with the screws 3 in tension, the screws 3 pulling the nuts 4 against the roof rails 32 of the positioning blocks 2, forcing and holding the retaining rails 24 of the positioning blocks 2 in place abuttingly against the longitudinal bases 76 of the longitudinal substantially L shaped retention guides 74 of the astragal 10, forcing and holding the lockset strike 6 and/or the deadbolt strike 7 in place abuttingly against the cover plates 5, and forcing and holding the cover plates 5 in place with the exterior edges 58 and the interior edges 60 of the cover plates 5 being forced into the longitudinal side channels 84 of the astragal 10, the longitudinal retaining lips 61 of the cover plates 5 abuttingly adjacent the longitudinal retaining lips 82 of the longitudinal side channels 84 of the astragal 10.

The positioning blocks 2 are preferably injection molded from an engineered plastic resin, such as an acetal, to provide the necessary flexural strength and properties for the spring leaves 26, although other suitable materials may be used. The astragal housing 66 and the cover plates 5 are preferably of metal, such as aluminum or steel, thermoplastics, thermosetting polymers, rubber, or other suitable material or combination thereof.

FIGS. 8–13 show alternate embodiments of astragals having astragal housings that the adjustable strike mounting system 1 may be used with, although other suitable astragals having other suitable astragal housings may be used.

Figure 8:
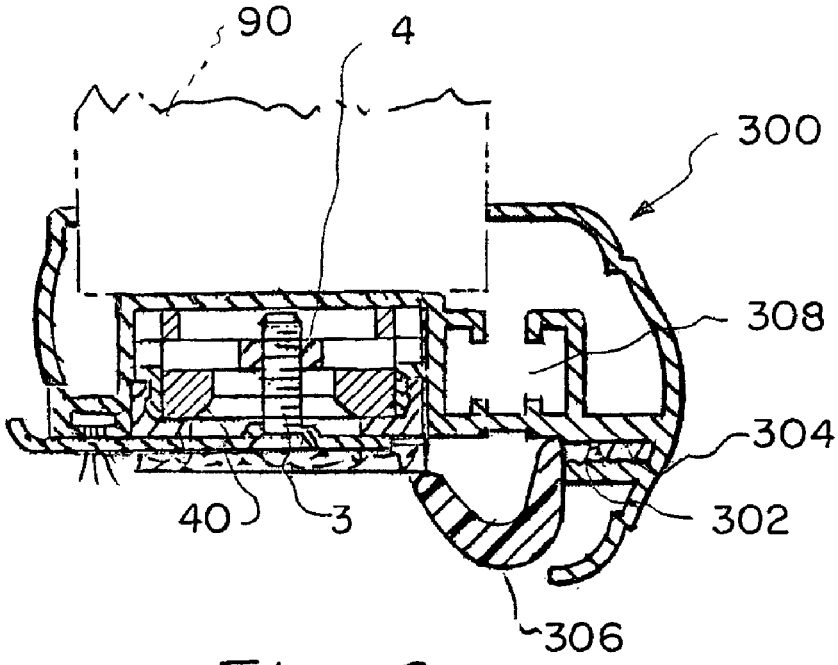
FIG. 8 is a section view of the strike mounting system shown with an alternate embodiment of an astragal installed thereon the inactive door.

FIG. 8 shows an alternate embodiment of an astragal housing 300, which has a saw-tooth recess 302 to retain finned tail 304 of a typical wrapped foam type weather strip 306 for sealing. The astragal housing 300 also has cavity 308.

Figure 9:
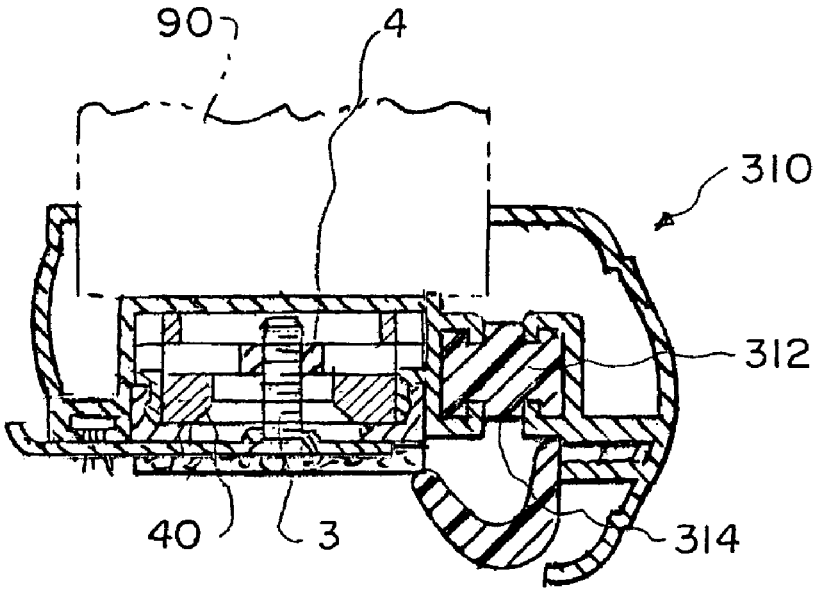
FIG. 9 is a section view of the strike mounting system shown with an alternate embodiment of an astragal installed thereon the inactive door.

FIG. 9 shows an alternate embodiment of an astragal housing 310, which is substantially the same as the astragal housing 300, except that the astragal housing 310 has thermal break 312, for installations in climates that experience extremely cold weather, in which the astragal housing 310 is fabricated from an aluminum extrusion, or other suitable material having substantially the same properties, which would otherwise readily lose heat to the outside and result in condensation, and in some cases even the formation of ice. The thermal break 312 is created by filling cavity 308 of the astragal housing 300 with a polyurethane thermal break compound, after which it is de-bridged by milling slot 314, thus, separating outer and inner portions of the astragal housing 310 and preventing infiltration of the cold.

Figure 10:
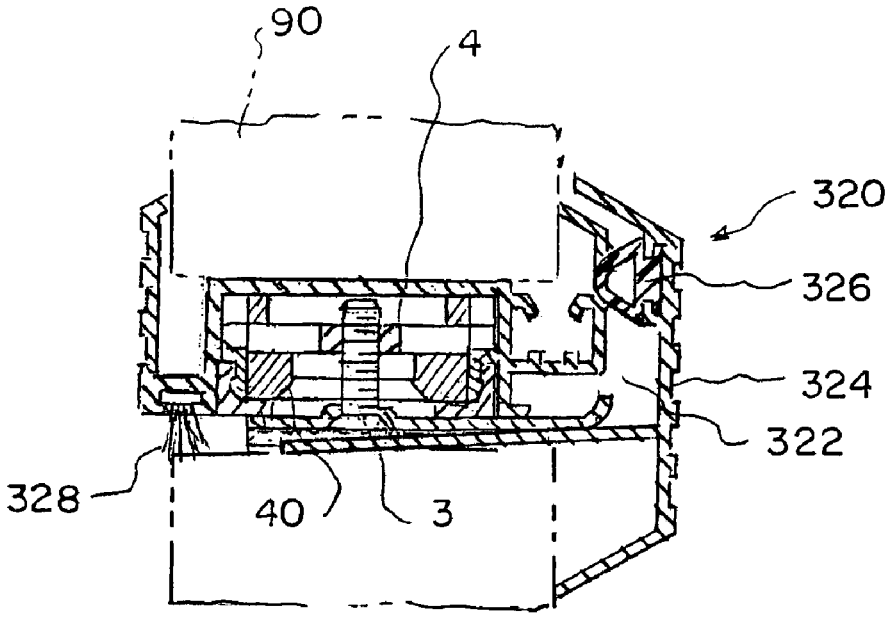
FIG. 10 is a section view of the strike mounting system shown with an alternate embodiment of an astragal installed thereon the inactive door, and also showing the active door.

FIG. 10 shows an alternate embodiment of an astragal 320, which may be used for installation on a pair of outlining rather than inswinging doors, which has astragal housing 322, cover 324 that provides overlap, and outer seal 326, and is used on the active leaf of the pair of out swinging doors. Inner seal 328 is of greater reach as the beveled edge of the active door is reversed, creating a greater gap at its inner edge.

Figure 11:
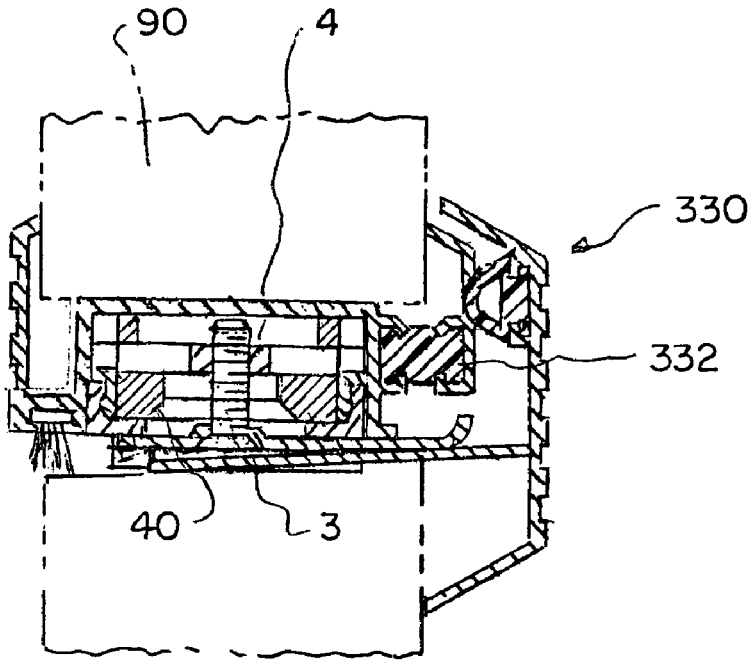
FIG. 11 is a section view of the strike mounting system shown with an alternate embodiment of an astragal installed thereon the inactive door, and also showing the active door.

FIG. 11 shows an alternate embodiment of an astragal 330, which may be used for installation on a pair of outwsinging rather than inswinging doors, which is substantially the same as the astragal housing 320, except that the astragal 330 has thermal break 332.

Figure 12:
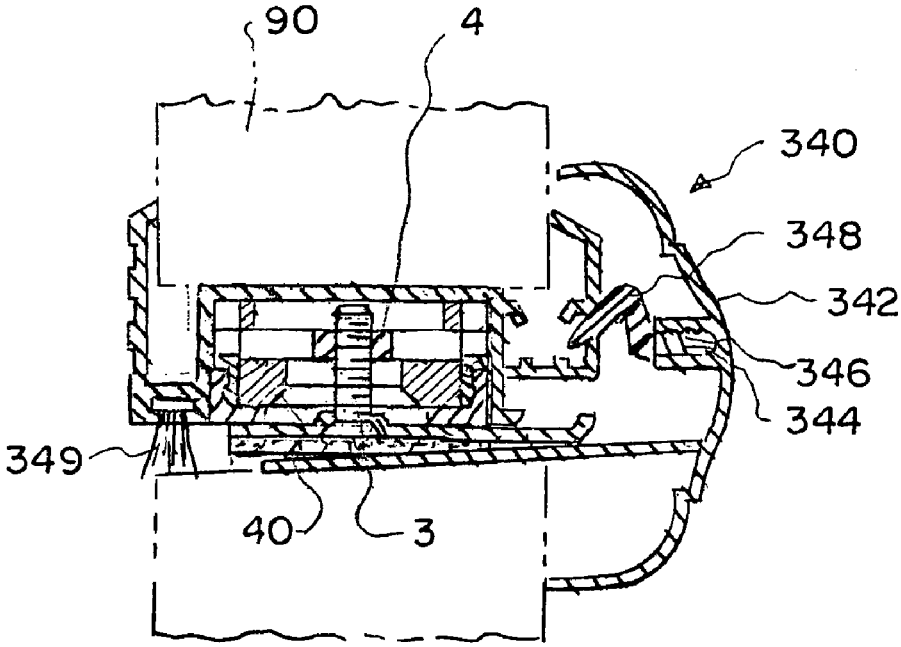
FIG. 12 is a section view of the strike mounting system shown with an alternate embodiment of an astragal installed thereon the inactive door, and also showing the active door.

FIG. 12 shows an alternate embodiment of an astragal 340, which may be used for installation on a pair of outwsinging rather than inswinging doors, in which cover element 342 has saw-tooth recess 344 to accommodate finned tail 346 of a wrapped foam weather strip seal 348. Inner seal 349 is of greater reach as the beveled edge of the active door is reversed, creating a greater gap at the inner edge.

Figure 13:
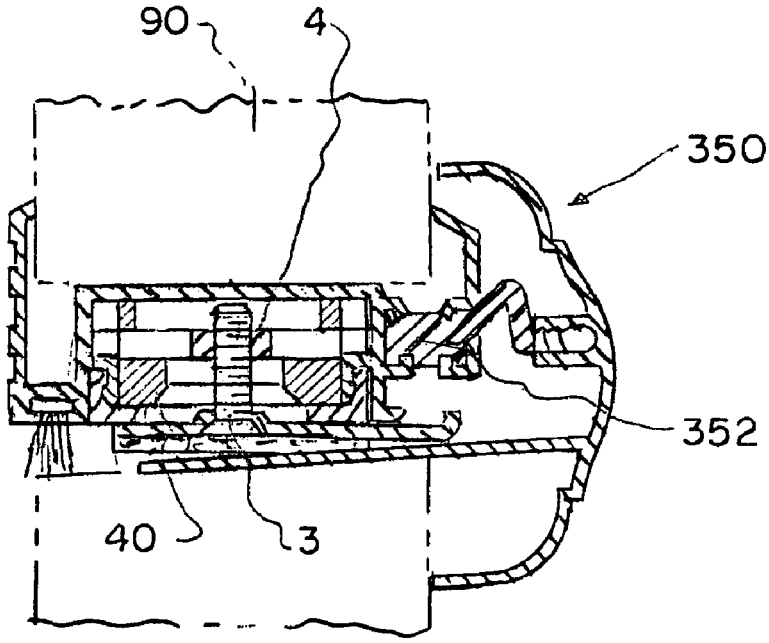
FIG. 13 is a section view of the strike mounting system shown with an alternate embodiment of an astragal installed thereon the inactive door, and also showing the active door.

FIG. 13 shows an alternate embodiment of an astragal 350, which may be used for installation on a pair of outwsinging rather than inswinging doors, which is substantially the same as the astragal housing 340, except that the astragal 350 has thermal break 352.

Although the present invention has been described in considerable detail with reference to certain preferred versions thereof, other versions are possible. Therefore, the spirit and scope of the appended claims should not be limited to the description of the preferred versions contained herein.

What is claimed is:

1. An adjustable strike mounting system, comprising:

a channel having an opening, a bottom and longitudinally disposed opposing tracks;

a cover plate straddling said opening and abutting said longitudinally disposed opposing tracks, said cover plate having an aperture;

male fasteners;

female fasteners;

a strike plate having an aperture and holes receiving said male fasteners therethrough;

said strike plate abutting said cover plate, said strike plate aperture and said cover plate aperture substantially common one with the other, said cover plate aperture receiving said male fasteners therethrough;

positioning blocks adapted to align said strike plate aperture with a bolt, each said positioning block having a chamber, said chamber having one of said female fasteners therein, and a hole from the exterior of said block to said chamber receiving one of said male fasteners therethrough, said male fastener mating with and fastened to said female fastener therein said chamber, said chamber adapted to retain said female fastener therein when said male fastener is fastened to said female fastener, and transverse sets of opposing rails and adjacent spring leaves, said transverse sets of opposing rails and adjacent spring leaves mounted therein said channel between said bottom and said opposing tracks of said channel.

2. The adjustable strike mounting system according to claim 1, wherein said bolt comprises a bolt of a lockset.

3. The adjustable strike mounting system according to claim 1, wherein said bolt comprises a deadbolt.

4. The adjustable strike mounting system according to claim 1, wherein said channel is disposed in an astragal.

5. The adjustable strike mounting system according to claim 1, wherein said strike comprises a lockset strike.

6. The adjustable strike mounting system according to claim 1, wherein said strike comprises a deadbolt strike.

7. The adjustable strike mounting system according to claim 1, wherein said positioning blocks are molded.

8. The adjustable strike mounting system according to claim 1, wherein said positioning blocks are of an acetal material.

9. The adjustable strike mounting system according to claim 1, wherein said positioning block holes are oblong.

10. The adjustable strike mounting system according to claim 1, wherein:

said positioning blocks are slidable within said channel for adjustably fastening said strike plate to said astragal;

said positioning blocks are locked in place within said channel when said male fasteners are fastened to said female fasteners.

11. The adjustable strike mounting system according to claim 9, wherein:

said male fasteners are slidable within said oblong holes for adjustably fastening said strike plate to said astragal;

said positioning blocks are locked in place within said channel when said male fasteners are fastened to said female fasteners.

12. The adjustable strike mounting system according to claim 9, wherein:

said positioning blocks are slidable within said channel for adjustably fastening said strike plate to said astragal;

said male fasteners are slidable within said oblong holes for adjustably fastening said strike plate to said astragal;

said positioning blocks are locked in place within said channel when said male fasteners are fastened to said female fasteners.

13. The adjustable strike mounting system according to claim 1, wherein said male fasteners are screws and said female fasteners are nuts.

14. An adjustable strike mounting system, for adjustably fastening a strike plate having an aperture and holes therethrough to an astragal having a channel having a bottom and sides having opposing retaining guides, comprising:

male fasteners;

female fasteners;

positioning blocks, each of said positioning blocks comprising a block and transverse sets of opposing retaining rails and adjacent spring leaves fastened to said block, said block having a hole and chamber therein, said chamber adapted to receive and retain one of said female fasteners therein, said hole adapted to receive one of said male fasteners therethrough and mate with said female fastener within said chamber;

said astragal channel having said positioning blocks placed therein, said opposing retaining rails of said positioning blocks adjacent said opposing retaining guides of said astragal, said spring leaves of said positioning blocks adjacent said bottom of said astragal channel, said spring leaves forcing said retaining rails of said positioning blocks to abut said retaining guides of said astragal and a portion of said spring leaves to abut said bottom of said channel;

a cover plate, said cover plate having an aperture therethrough and sides, said cover plate sides adjacent said astragal retaining guides;

said male fasteners inserted through said holes of said strike plate through said aperture of said cover plate and fastened to said female fasteners in said positioning blocks, forcing said strike plate to abut said cover plate and said cover plate to abut said astragal retaining guides, and fasten said strike plate to said astragal.

15. The adjustable strike mounting system according to 14, wherein said positioning block holes are oblong.

16. The adjustable strike mounting system according to claim 14, wherein:

said positioning blocks are slidable within said astragal channel for adjustably fastening said strike plate to said astragal;

said positioning blocks are locked in place within said astragal channel when said male fasteners are fastened to said female fasteners.

17. The adjustable strike mounting system according to claim 15, wherein:

said male fasteners are slidable within said oblong holes for adjustably fastening said strike plate to said astragal;

said positioning blocks are locked in place within said astragal channel when said male fasteners are fastened to said female fasteners.

18. The adjustable strike mounting system according to claim 15, wherein:

said positioning blocks are slidable within said astragal channel for adjustably fastening said strike plate to said astragal;

said male fasteners are slidable within said oblong holes for adjustably fastening said strike plate to said astragal;

said positioning blocks are locked in place within said astragal channel when said male fasteners are fastened to said female fasteners.

19. The adjustable strike mounting system according to claim 14, wherein said positioning block holes are countersunk.

20. The adjustable strike mounting system according to claim 14, wherein said male fasteners are screws and said female fasteners are nuts.

21. The adjustable strike mounting system according to claim 14, wherein said strike plate comprises a lockset strike.

22. The adjustable strike mounting system according to claim 14, wherein said strike plate comprises a deadbolt strike.

23. The adjustable strike mounting system according to claim 14, wherein said positioning blocks are molded.

24. The adjustable strike mounting system according to claim 14, wherein said positioning blocks are of an acetal material.

25. The adjustable strike mounting system according to claim 14, wherein said positioning block chambers have nibs adapted to retain said female fasteners therein.

26. An adjustable strike mounting system, for adjustably fastening a strike plate having an aperture and holes therethrough to an astragal having a channel having a bottom and sides having opposing retaining guides, comprising:

male fasteners;

female fasteners;

positioning blocks;

each of said positioning blocks comprising a block having a top, a bottom, opposing sides, and opposing ends, and transverse sets of opposing retaining rails and adjacent spring leaves fastened to said opposing ends of said block, said block having a chamber, which has a roof having roof rails and a floor having floor rails, said block having a hole therethrough from one of said opposing ends to said other one of said opposing ends, an oblong hole through said top of said block to said roof of said chamber, and a hole from said floor of said chamber to said bottom of said block, said chamber adapted to receive and retain one of said female fasteners therein;

said astragal channel having said positioning blocks placed therein, said opposing retaining rails of said positioning blocks adjacent said opposing retaining guides of said astragal, said spring leaves of said positioning blocks adjacent said bottom of said astragal channel, said spring leaves forcing said retaining rails of said positioning blocks to abut said retaining guides of said astragal and a portion of said spring leaves to abut said bottom of said channel;

a cover plate;

said cover plate having an aperture therethrough and sides, said cover plate sides adjacent said astragal retaining guides;

said male fasteners inserted through said holes of said strike plate through said aperture of said cover plate and fastened to said female fasteners in said positioning blocks, forcing said female fasteners against said roof rails of said positioning blocks, forcing said retaining rails of said positioning blocks to abut said retaining guides of said astragal, forcing said strike plate to abut said cover plate and said cover plate sides to abut said astragal retaining guides, and fasten said strike plate to said astragal.

27. The adjustable strike mounting system according to claim 26, wherein:

said positioning blocks are slidable within said astragal channel for adjustably fastening said strike plate to said astragal;

said positioning blocks are locked in place within said astragal channel when said male fasteners are fastened to said female fasteners.

28. The adjustable strike mounting system according to claim 26, wherein:

said male fasteners are slidable within said oblong holes for adjustably fastening said strike plate to said astragal;

said positioning blocks are locked in place within said astragal channel when said male fasteners are fastened to said female fasteners.

29. The adjustable strike mounting system according to claim 26, wherein:

said positioning blocks are slidable within said astragal channel for adjustably fastening said strike plate to said astragal;

said male fasteners are slidable within said oblong holes for adjustably fastening said strike plate to said astragal;

said positioning blocks are locked in place within said astragal channel when said male fasteners are fastened to said female fasteners.

30. The adjustable strike mounting system according to claim 26, wherein said positioning block oblong holes are countersunk.

31. The adjustable strike mounting system according to claim 26, wherein said male fasteners are screws and said female fasteners are nuts.

32. The adjustable strike mounting system according to claim 26, wherein said strike plate comprises a lockset strike.

33. The adjustable strike mounting system according to claim 26, wherein said strike plate comprises a deadbolt strike.

34. The adjustable strike mounting system according to claim 26, wherein said positioning blocks are molded.

35. The adjustable strike mounting system according to claim 26, wherein said positioning blocks are of an acetal material.

36. The adjustable strike mounting system according to claim 26, wherein said positioning block chambers have nibs adapted to retain said female fasteners therein.

* * * * *